United States Patent [19]

Du Bois et al.

[11] 4,075,070

[45] Feb. 21, 1978

[54] ELECTRODE MATERIAL

[75] Inventors: Donald W. Du Bois; William B. Darlington, both of Corpus Christi, Tex.

[73] Assignee: PPG Industries, Inc., Pittsburgh, Pa.

[21] Appl. No.: 694,506

[22] Filed: June 9, 1976

[51] Int. Cl.[2] ..... C25B 1/02; C25B 1/14; C25B 11/10

[52] U.S. Cl. ..... 204/129; 204/290 F; 204/293

[58] Field of Search ..... 204/293, 290 F, 59 R, 204/129, 290 R, 128; 75/175.5

[56] References Cited

U.S. PATENT DOCUMENTS

| | | | |
|---|---|---|---|
| 3,070,468 | 12/1962 | Grant | 75/175.5 X |
| 3,074,829 | 1/1963 | Novy et al. | 75/175.5 X |
| 3,378,671 | 4/1968 | Harrison et al. | 219/148 |
| 3,622,406 | 11/1971 | Vordahl | 148/32 |
| 3,679,403 | 7/1972 | Bomberger et al. | 75/175.5 |
| 3,706,644 | 12/1972 | Martinsons | 204/98 |
| 3,751,296 | 8/1973 | Beer | 204/290 F |
| 3,804,740 | 4/1974 | Welch | 204/290 R |
| 3,993,453 | 11/1976 | Ross et al. | 29/191.2 |

*Primary Examiner*—F.C. Edmundson
*Attorney, Agent, or Firm*—Richard M. Goldman

[57] ABSTRACT

Disclosed is an improved method of electrolysis utilizing an electrode fabricated from an alloy of titanium and a rare earth metal. The electrode may be a cathode, or, when having a suitable electrocatalytic coating, an anode, or even a bipolar electrode with anodic and cathodic regions. Also disclosed are electrolytic cells containing such a bipolar electrode, and electrolytic cells containing electrodes fabricated of alloys of titanium and rare earth metals.

4 Claims, No Drawings

ELECTRODE MATERIAL

DESCRIPTION OF THE INVENTION

Titanium and titanium alloys find extensive use in electrolytic cell service. For example, in electrolytic cells useful in the evolution of chlorine, alkali metal hydroxide, and hydrogen, the anodes are frequently coated titanium anodes. Similarly, in electrolytic cells for the evolution of alkali metal chlorates, the anodes are frequently coated titanium anodes while the cathodes are uncoated titanium. Thus, in bipolar electrolyzers, especially for the evolution of alkali metal chlorates, an individual bipolar electrode may be a single titanium member with an uncoated cathodic surface and a coated anodic surface.

One problem encountered in the use of titanium electrodes, especially as cathodes, is the uptake of hydrogen by the titanium and the consequent formation of titanium hydride within the electrodes. Another problem is the high overvoltage of hydrogen evolution on titanium cathodes.

It has now been found that the rate of titanium hydride formation may be reduced and the hydrogen overvoltage may be reduced if the titanium is present as an alloy with a rare earth metal.

DETAILED DESCRIPTION

According to an exemplification of the invention disclosed herein, an electrode of an alloy of titanium and a rare earth metal may be used as an anode, a cathode, or as a bipolar electrode. According to one embodiment of this invention, an electrode is provided that is an alloy of titanium and a rare earth metal. The electrode may be an anode having a substrate of the titanium-rare earth metal alloy and a surface coating of a different material. Where the electrode is an anode, electrical current passes from the anode to the electrolyte, evolving an anodic product, such as chlorine when the electrolyte is aqueous alkali metal chloride.

According to an alternative embodiment, the electrode may be a cathode. When the electrode is a cathode, the electrode surface itself may be the cathodic surface of the electrode. In this way, electrical current can pass from the electrolyte to the cathode, evolving a cathodic product on the surface of the titanium-rare earth metal alloy, for example, hydrogen when the electrolyte is an aqueous electrolyte.

According to a still further embodiment, the electrode may be a bipolar electrode of a titanium-rare earth metal alloy. One surface of the bipolar electrode, which may or may not be coated, faces the anode of a prior bipolar electrode and functions as the cathode of the bipolar electrode. The opposite surface of the electrode, coated with an electrocatalytic material, faces the cathode of a subsequent electrode, thereby functioning as the anode of the bipolar electrode.

The alloys contemplated in this invention are alloys of titanium and a rare earth metal or metals. Contemplated rare earth metals include scandium, yttrium, and the lanthanides. The lanthanides are lanthanum, cerium, praesodymium, neodymium, promethium, samerium, europium, gadolinium, terbium, dysprosium, holmium, erbium, thulium, ytterbium, and lutetium. Whenever the term "rare earth metals" is used herein, it is intended to encompass scandium, yttrium, and the lanthanides.

The rare earth metal alloying agent may be one or more rare earth metals. For example, it may be scandium or yttrium or cerium, or lanthanum or lanthanum and yttrium or lanthanum and cerium. Most commonly, the rare earth metal alloying addition will be yttrium.

The amount of rare earth metal alloying agent should be at least a threshold amount sufficient to diminish or even dominate the uptake of hydrogen by the titanium. This is generally at least about 0.01 weight percent, although lesser amounts have positive effects. The maximum amount of rare earth metal alloying agents should be low enough to avoid substantial formation of a two phase system. Generally, this is less than about 2 weight percent rare earth metal for the rare earth metals yttrium, lanthinum, cerium, gadolinium, and erbium although amounts up to about 4 or even 5 percent by weight thereof can be tolerated without adverse effects, and less than about 7 weight percent rare earth for the rare earth metals scandium and europium, although amounts up to 10 percent by weight may be tolerated without deleterious effects. Generally the amount of rare earth metal is from about 0.01 weight percent to about 1 weight percent, and preferably from about 0.015 weight percent to about 0.05 weight percent.

The titanium alloy may also contain various impurities without deleterious effect. These impurities include iron in amounts normally above about 0.01 percent or even 0.1 percent and frequently as high as 1 percent, vanadium and tantalum in amounts up to about 0.1 percent or even 1 percent oxygen in amounts up to about 0.1 weight percent, and carbon in amounts up to about 0.1 weight percent.

When the electrode is an anode, the anode typically has a surface thereon of an electrocatalytic, electroconductive material different than the titanium-rare earth metal alloy substrate.

The preferred materials used for the electroconductive coating are those which are electrocatalytic, electroconductive and chemically inert, i.e. resistant to anodic attack. Electrocatalytic materials are those materials characterized by a low chlorine overvoltage, e.g. less than 0.25 volts at a current density of 200 amperes per square foot.

A suitable method of determining chlorine overvoltage is as follows:

A two-compartment cell constructed of polytetrafluorethylene with a diaphragm composed of asbestos paper is used in the measurement of chlorine overpotentials. A stream of water-saturated $Cl_2$ gas is dispersed into a vessel containing saturated NaCl, and the resulting $Cl_2$-saturated brine is continuously pumped into the anode chamber of the cell. In normal operation, the temperature of the electrolyte ranges from 30° to 35° C, most commonly 32° C, at a pH of 4.0. A platinized titanium cathode is used.

In operation, an anode is mounted to a titanium holder by means of titanium bar clamps. Two electrical leads are attached to the anode; one of these carries the applied current between anode and cathode at the voltage required to cause continuous generation of chlorine. The second is connected to one input of a high impedance voltmeter. A Luggin tip made of glass is brought up to the anode surface. This communicates via a salt bridge filled with anolyte with a saturated calomel half cell. Usually employed is a Beckman miniature fiber junction calomel such as catalog No. 39270, but any equivalent one would be satisfactory. The lead from the calomel cell is attached to the second input of the voltmeter and the potential read.

Calculation of the overvoltage, $\eta$, is as follows:

The International Union of Pure and Applied Chemistry sign convention is used, and the Nernst equation taken in the following form:

$$E = E_o + 2.303\ RT/nF \log [\text{oxidized}]/[\text{reduced}]$$

Concentrations are used for the terms in brackets instead of the more correct activities.

$E_o$ = the standard state reversible potential = +1.35 volts $n$ = number of electrons equivalent$^{-1}$ = 1

R, gas constant, = 8.314 joule deg$^{-1}$ mole$^{-1}$

F, the Faraday, = 96,500 couloumbs equivalent$^{-1}$ $Cl_2$ concentration = 1 atm $Cl^-$concentration = 5.4 equivalent liter$^{-1}$ (equivalent to 305 grams NaCl per liter)

T = 305° K

For the reaction:

$$Cl \rightarrow \tfrac{1}{2}Cl_2 = e^-$$

$$E = 1.35 + 0.060 \log 1/5.4 = 1.30$$

This is the reversible potential for the system at the operating conditions. The overvoltage on the normal hydrogen scale is, therefore, $$\eta = V - [E - 0.24]$$

where

V is the measured voltage,

E is the reversible potential, 1.30 volts; and 0.24 volt is the potential of the saturated calomel half cell.

The preferred electroconductive, electrocatalytic materials are further characterized by their chemical stability and resistance to chlorine attack or to anodic attack in the course of electrolysis.

Suitable coating materials include the platinum group metals, platinum, ruthenium, rhodium, palladium, osmium, and iridium. The platinum group metals may be present in the form of mixtures or alloys such as palladium with platinum or platinum with iridium. An especially satisfactory palladium-platinum combination contains up to about 15 weight percent platinum and the balance palladium. Another particularly satisfactory coating is metallic platinum with iridium, especially when containing from about 10 to about 35 percent iridium. Other suitable metal combinations include ruthenium and osmium, ruthenium and iridium, ruthenium and platinum, rhodium and osmium, rhodium and iridium, rhodium and platinum, palladium and osmium, and palladium and iridium. The production or use of many of these coatings on other substrates are disclosed in U.S. Pat. Nos. 3,630,768, 3,491,014, 3,242,059, 3,236,756, and others.

The electroconductive material also may be present in the form of an oxide of a metal of the platinum group such as ruthenium oxide, rhodium oxide, palladium oxide, osmium oxide, iridium oxide, and platinum oxide. The oxides may also be a mixture of platinum group metal oxides, such as platinum oxide with palladium oxide, rhodium oxide with platinum oxide, ruthenium oxide with platinum oxide, rhodium oxide with iridium oxide, rhodium oxide with osmium oxide, rhodium oxide with platinum oxide, ruthenium oxide with platinum oxide, ruthenium oxide with iridium oxide, and ruthenium oxide with osmium oxide.

There may also be present in the electroconductive surface, oxides which themselves are non-conductive or have low conductivity. Such materials, while having low bulk conductivities themselves, may nevertheless provide good conductive films with containing one or more of the above mentioned platinum group metal oxides and may have open or porous structures thereby permitting the flow of electrolyte and electrical current therethrough or may serve to more tightly bond the oxide of the platinum metal to the titanium alloy base. For example, aluminum oxide, silicon oxide, titanium oxide, zirconium oxide, niobium oxide, hafnium oxide, tantalum oxide, or tungsten oxide may be present with the more highly conductive platinum group oxide in the surface coating. Carbides, nitrides and silicides of these metals or of the platinum group metals also may be used to provide the electroconductive surface.

Where a plurality of coatings are applied it is advantageous to apply the outer coatings as mixtures of the type here described. For example, an electrode may be provided having a base or substrate as described herein with a surface thereon containing a mixed oxide coating comprising ruthenium dioxide and titanium dioxide, or ruthenium dioxide and zirconia, or ruthenium dioxide and tantalum dioxide. Additionally, the mixed oxide may also contain metallic platinum, osmium, or iridium. Oxide coatings suitable for the purpose herein contemplated are described in U.S. Pat. No. 3,632,408 granted to H. B. Beer.

Other electroconductive coatings which may be deposited on the titanium-rare earth metal alloy base are the bimetal and trimetal spinels. Such spinels include $MgFeAlO_4$, $NiFeAlO_4$, $CuAl_2O_4$, $CoAl_2O_4$, $FeAl_2O_4$, $FeAlFeO_4$, $NiAl_2O_4$, $MoAl_2O_4$, $MgFe_2O_4$, $CoFe_2O_4$, $NiFe_2O_4$, $CuFe_2O_4$, $ZnFe_2O_4$, $CdFe_2O_4$, $PbFe_2O_4$, $MgCo_2O_4$, $ZnCo_2O_4$, and $FeNi_2O_4$. The preferred bimetal spinels are the heavy metal aluminates, e.g. cobalt aluminate ($CoAl_2O_4$), nickel aluminate ($NiAl_2O_4$) and the iron aluminates ($FeAlFeO_4$, $FeAl_2O_4$). The bimetal spinels may be present as discrete clusters on the surface of the titanium-rare earth metal alloy substrate. A particularly satisfactory electrode is provided by an outer surface containing discrete masses of cobalt aluminate on a titanium-rare earth metal alloy substrate having an underlying platinum coating thereon from 2 to 100 or more micro-inches thick disposed on the substrate. The bimetal spinels may also be present as a porous, external layer, with a conductive layer of platinum group metal or platinum group metal oxide, e.g. ruthenium oxide or platinum interposed between the base and the spinel coating. The bimetal spinel layer, having a porosity of from about 0.70 to about 0.95, and a thickness of from about 100 micro-inches to about 400 or more micro-inches thick provides added sites for surface catalyzed reactions. A particularly satisfactory electrode may be provided according to this exemplification having an electroconductive titanium-rare earth metal alloy substrate, an intermediate layer of platinum from 10 to 100 micro-inches thick, and a layer of cobalt aluminate spinel having a porosity of from about 0.70 to about 0.95 and a thickness of from about 100 to about 400 micro-inches thick. Alternatively, especially for mercury cathode cell service, ruthenium dioxide may be substituted for the platinum, providing an electrode having a silicon substrate, a ruthenium dioxide layer in electrical and mechanical contact with the silicon substrate, and a layer of spinel on the ruthenium dioxide layer.

Still other electroconductive, electrocatalytic materials useful in providing anode coatings include the oxides of lead, and tin.

The electrodes contemplated herein may be used as cathodes, as anode substrates, or as bipolar electrodes, with one surface being an anode substrate and another surface being a cathode. When the electrodes contemplated herein are used as cathodes, the metal surface of the electrode, that is, the titanium-rare earth metal alloy surface, functions as a cathode, e.g. for hydrogen evolution from aqueous media. According to one exemplification, the electrodes contemplated herein may be utilized as cathodes in the production of alkali metal chlorates such as potassium chlorate or sodium chlorate, with hydrogen being evolved on the titanium-rare earth metal alloy surface.

The electrodes may be bipolar electrodes interposed between adjacent cells in a bipolar electrolyzer. When so utilized, one side of the bipolar electrode has a surface coating of a material different than the titanium-rare earth metal alloy and functions as an anode and the opposite side functions as a cathode.

The titanium-rare earth metal alloy cathodes contemplated herein have a low hydrogen evolution voltage. For example, while a titanium-0.2 weight percent palladium cathode has a hydrogen discharge potential of −1.44 volts (−1.64 volts versus silver-silver chloride/-saturated KCl electrode) at 232 amperes per square foot, a titanium-0.02 weight percent yttrium cathode has a hydrogen discharge potential of −1.36 volts (−1.56 volts versus silver-silver chloride/saturated KCl electrode) at 232 amperes per square foot.

Additionally, when utilized as cathodes, the titanium-rare earth metal alloys contemplated herein have low hydrogen uptake. This is evidenced by a low weight gain when so utilized. For example, in tests conducted over a period of 21 days, where titanium coupons were utilized as cathodes, commercial titanium alloy coupon containing 0.3 weight percent molybdenum and 0.8 percent nickel had a weight increase of 0.1138 weight percent, a titanium-0.2 weight percent palladium coupon cathode had a weight increase of 0.0335 weight percent, and a titanium-0.02 weight percent yttrium cathode had a weight increase of 0.0164 weight percent.

The following examples are illustrative.

EXAMPLE I

Three titanium coupons were tested as cathodes in a 10 weight percent aqueous $Na_2SO_4$ solution.

One coupon was prepared from an alloy containing 0.2 weight percent palladium and the balance titanium. The second coupon was prepared from commercial Ti-38A titanium alloy. The third alloy was prepared from a titanium-yttrium alloy containing 0.02 weight percent yttrium, 0.07 weight percent iron, 0.061 weight percent oxygen, 0.008 weight percent nitrogen, 0.03 weight percent carbon, and 25 parts per million hydrogen.

The coupons were cleaned in an aqueous solution prepared from 3 volume percent HF, 30 volume percent $HNO_3$, balance water. Thereafter, each coupon was taped so that only a 1-inch by 1-inch segment was exposed to the electrolyte. Each coupon was then placed in a separate container of 10 weight percent $Na_2SO_4$ and tested as a cathode at a current density of 232 amperes per square foot. The weight increases shown in Table I were obtained.

TABLE I

Cumulative Percentage Weight Increases of Titanium Coupons

| Coupon Weight | Ti-0.3% Mo - 0.8% Ni Alloy 19.0678 gm | Ti-2% Pd Alloy 15.2014 gm | Ti-.02% Y Alloy 20.0745 gm |
|---|---|---|---|
| Days Under Test | | | |
| 7 | .059% | .024% | — |
| 11 | — | — | .012% |
| 14 | .093% | .030% | — |
| 16 | — | — | .014% |
| 20 | — | — | .016% |
| 21 | .114% | .034% | — |
| 27 | — | — | .018% |
| 28 | .124% | .030% | — |
| 34 | — | — | .018% |
| 35 | .111% | .025% | — |
| 41 | — | — | .020% |
| 46 | .077% | .023% | — |
| 48 | — | — | .020% |
| 51 | .088% | .020% | — |
| 91 | −.062% | .016% | .020% |

Actual weight losses indicated physical separation of the titanium hydride.

EXAMPLE II

The hydrogen evolution voltages on the Ti-0.2 weight percent palladium alloy coupon and on the Ti-0.02 weight percent yttrium alloy coupon were tested at 50° C and 232 amperes per square inch versus a silver-silver chloride electrode in saturated potassium chloride. The measured hydrogen evolution voltages were 1.64 volts for the titanium-palladium alloy coupon and 1.56 volts for the titanium-yttrium alloy.

While the invention has been described with reference to specific embodiments and exemplifications thereof, the invention is not to be so limited except as in the claims appended hereto.

We claim:

1. In a method of electrolysis where an electrical current is passed from an anode through an aqueous electrolyte to a metal cathode whereby to evolve hydrogen at a surface of said metal cathode, the improvement wherein the surface of the metal cathode is an alloy of titanium and a rare earth metal.

2. The method of claim 1 wherein said rare earth metal is yttrium.

3. The method of claim 2 wherein said alloy comprises from about 0.01 to about 1.0 weight percent yttrium.

4. In a method of electrolysis where an electrical current is passed from an anode through an aqueous electrolyte to a metal cathode whereby to evolve hydrogen at a surface of said metal cathode, the improvement wherein the surface of said metal cathode comprises an alloy of titanium and yttrium.

* * * * *